United States Patent [19]

Schneider

[11] Patent Number: 4,480,850

[45] Date of Patent: Nov. 6, 1984

[54] TOE HOLDER FOR SAFETY SKI BINDINGS

[76] Inventor: Klaus Schneider, 8104 Grainau, Fed. Rep. of Germany

[21] Appl. No.: 420,829

[22] Filed: Sep. 21, 1982

[30] Foreign Application Priority Data

Sep. 21, 1981 [DE] Fed. Rep. of Germany ..... 3137485

[51] Int. Cl.[3] ..... A63C 9/08

[52] U.S. Cl. ..... 280/630

[58] Field of Search ..... 280/629, 630, 631, 628, 280/626

[56] References Cited

U.S. PATENT DOCUMENTS

| | | | |
|---|---|---|---|
| 3,027,173 | 3/1962 | Beyl | 280/629 |
| 3,845,966 | 11/1974 | Ulbrich | 280/630 |
| 4,095,821 | 6/1978 | Salomon | 280/628 |

FOREIGN PATENT DOCUMENTS

| | | | |
|---|---|---|---|
| 245454 | 6/1965 | Austria | 280/629 |
| 1578737 | 6/1971 | Fed. Rep. of Germany . | |
| 1578999 | 8/1974 | Fed. Rep. of Germany . | |
| 96351 | 6/1972 | France | 280/630 |

*Primary Examiner*—Joseph F. Peters, Jr.
*Assistant Examiner*—Michael Mar

[57] ABSTRACT

A toe holder for safety ski bindings having a housing, an axle attached to the housing and perpendicular to the top surface of the ski, a sole engaging unit pivotally mounted to the axle and movable between a skiing and a releasing position, and a spring biasing the sole engaging unit towards its skiing position; the axle having a guide groove for urging the sole engaging unit upwards along its pivot axis as the unit pivots from its skiing to its releasing position.

6 Claims, 2 Drawing Figures

TOE HOLDER FOR SAFETY SKI BINDINGS

BACKGROUND OF THE INVENTION

This invention relates to toe holders for safety ski bindings and in particular to toe holders providing for movement vertically with respect to the surface of a ski, as well as laterally.

For a skier's maximum safety and convenience, it is important that, while skiing, each ski boot is rigidly fixed with respect to the ski. Additionally, to minimize injury to the skier, it is important that the ski boot is disengaged from the ski in the event of imminent fall. To achieve these goals, safety ski bindings have been developed for releasing a ski boot from a ski when applied forces exceed a predetermined value.

Toe holders for safety ski bindings have been designed to achieve release of the toe portion of a ski boot from the ski when predetermined forces in the plane of the ski surface which act to twist the skier's leg are applied. It is useful to have a toe holder which provides for lateral movement with the boot as lateral forces are applied to the boot and, in addition, returns to its skiing position on removal of the applied force. Such a toe holder provides several advantages. When a ski boot is released from the ski, the toe holder will return to a position in which it is ready to again receive the ski boot. This minimizes the need to manually reset the toe holder, a task which is quite awkward and inconvenient in a typical skiing environment. A second advantage of such toe holders is that they may assist in absorbing applied forces which, though insufficient to necessitate release of the ski boot from the ski, may inhibit maximum skiing comfort and safety. This is achieved because the toe holder provides some give to the ski boot, allowing limited lateral movement without releasing the boot, followed by return of the toe holder and the boot to the normal skiing position.

A problem that has been encountered with toe holders as described above is that vertical forces acting on the skier's leg often create frictional forces in the toe holder which inhibit lateral movement of the sole engaging unit and, thus, inhibit appropriate release of the ski boot from the ski. The toe holder often comprises a housing fixed with respect to the ski and having an axle perpendicular to the top surface of the ski. The sole engaging unit of the toe holder is pivotally mounted on the axle, providing for lateral movement of the toe of the ski boot. This accomodates that component of applied force which acts in the plane of the top surface of the ski, however, applied forces acting on the ski do not generally act strictly in the plane of the ski, but also have a vertical component. This vertical component may act on the sole engaging unit in such a manner that frictional forces arise between the pivotally mounted sole engaging unit and fixed parts of the toe holder. These frictional forces inhibit lateral movement of the sole engaging unit, for it is necessary for an applied force to exceed both the frictional force and the predetermined release force before release may be achieved. In this manner, forces dangerous to the skier may be applied without having release of the ski boot from the ski.

Frictional forces also may arise when snow or other foreign matter gets between the bottom of the ski boot and the top surface of the ski. The toe holder is height-adjusted to receive the toe of the ski boot when the sole of the boot is flush against the ski. With foreign matter between the sole and the ski, the toe of the boot will be higher than the toe holder setting. A downward force must then be exerted to urge the toe into the sole engaging unit, causing an upward vertical force to be exerted against the sole engaging unit. Again, this vertical force may cause frictional forces which inhibit lateral movement of the ski boot and its release from the ski. Improper height adjustment of a toe holder may also introduce such frictional forces.

Furthermore, there are instances where purely vertical forces are applied to the toe piece by a skier's boot—such as in the event of a backward fall—when release of the binding is desired. Neither bindings which do not open in response to purely vertical forces, nor complex bindings which do open in such an event, are satisfactory.

Toe holders proposed in the art do not deal satisfactorily with the problem of frictional forces while providing the above discussed beneficial characteristics. German Application DE PS No. 1,578,999 (Wunder) proposes a toe holder having a sole engaging unit that is both axially and pivotally mounted, however, because of its design, the shock sensitivity of that toe holder is unsatisfactory. Additionally, it does not provide for automatic return of the toe holder to the skiing position on release of the ski boot from the ski.

U.S. Pat. No. 3,027,173 (Beyl) proposes toe holders designed to provide for lateral movement of a ski boot toe and for automatic return to the skiing position. However, no provision is made to accommodate the vertical component of applied force, thus such toe holders do not deal with the problem of frictional forces which may inhibit appropriate release of the ski boot. The fact that the toe holder is biased towards its skiing position enhances the danger created by the frictional forces.

U.S. Pat. No. 4,095,821 (Salomon) proposes toe holders designed to accommodate both torsional and vertical forces. However, when set at low release values such toe holders do not fix the toe of the ski boot rigidly to the ski, instead allowing the toe some vertical movement, referred to as "swimming". Additionally, construction of toe holders according to that disclosure is quite expensive.

This invention provides a toe holder having a sole engaging unit which is movable laterally about a pivot axis and also axially along that pivot axis. The axial movement is provided to compensate for vertical forces applied to toe of a ski boot. With a toe holder according to this invention in its skiing position, vertical movement of the ski boot toe is restricted, thus inhibiting the problem of "swimming" of the toe. A toe holder according to the preferred embodiment of this invention is inexpensive to construct and its design provides for a minimum of potential mechanical problems.

SUMMARY OF THE INVENTION

This invention in its preferred form provides toe holders for safety ski bindings movable between a skiing position and a releasing position. The toe holder has a housing with an axle perpendicular to the top surface of the ski. Pivotally mounted on the axle is a sole engaging unit comprising a pivot member and a sole engaging member. The sole engaging member is fixed to the pivot member and is height adjustable with respect to the pivot member.

A spring biases the sole engaging unit towards its skiing position in which it holds a ski boot toe rigidly to a ski. The sole engaging unit may be pivoted against the force of the spring towards its release position, in which position the ski boot is released from the ski. The spring may be adjusted to vary the force required to pivot the sole engaging unit about the axle.

The axle is provided with a guide groove which engages a bearing mounted in the pivot member. The guide groove is upward sloping on each side of the axle from a point at the rearmost portion of the axle. The guide groove engages a bearing mounted in the pivot member, thus, pivotal movement of the sole engaging unit from its skiing position towards its releasing position results in upward vertical movement of the unit along its pivot axis. Conversely, return of the unit to its skiing position results in downward movement of the unit along its pivot axis.

DESCRIPTION OF THE PREFERRED EMBODIMENTS

Figure 1:
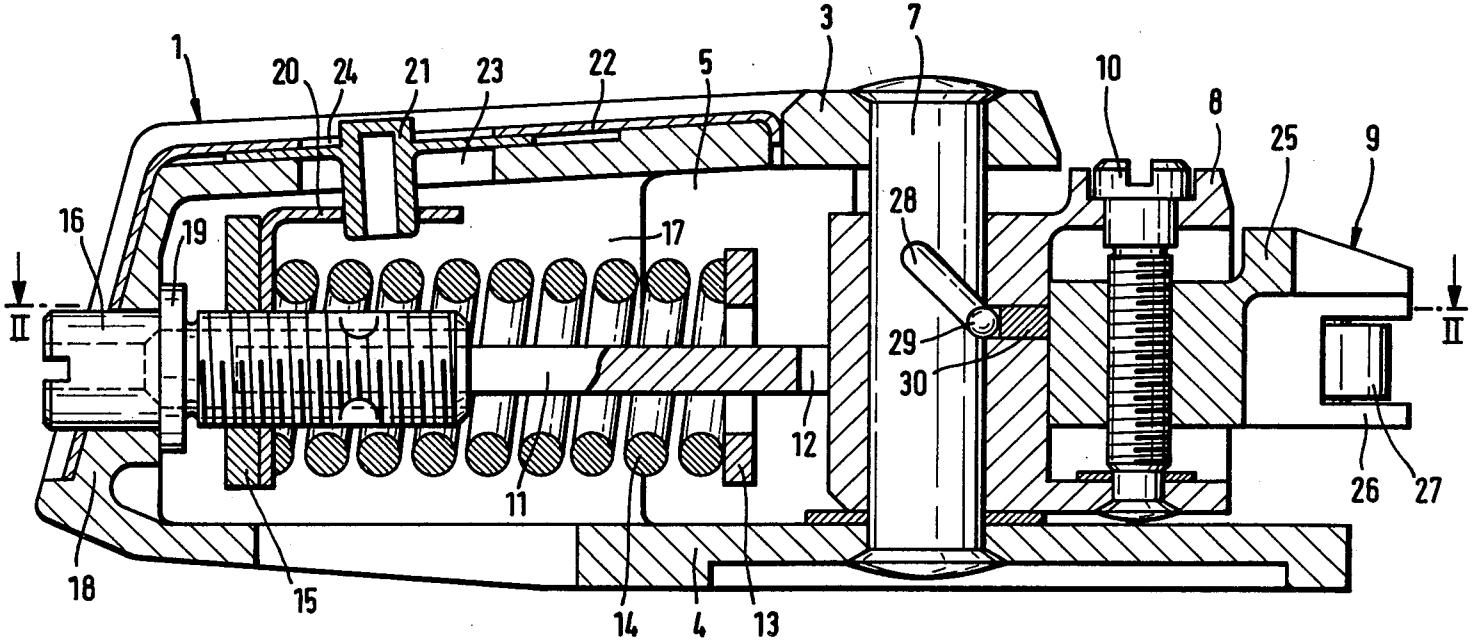
FIG. 1 A longitudinal cross-section of a toe holder according to this invention.
Figure 2:
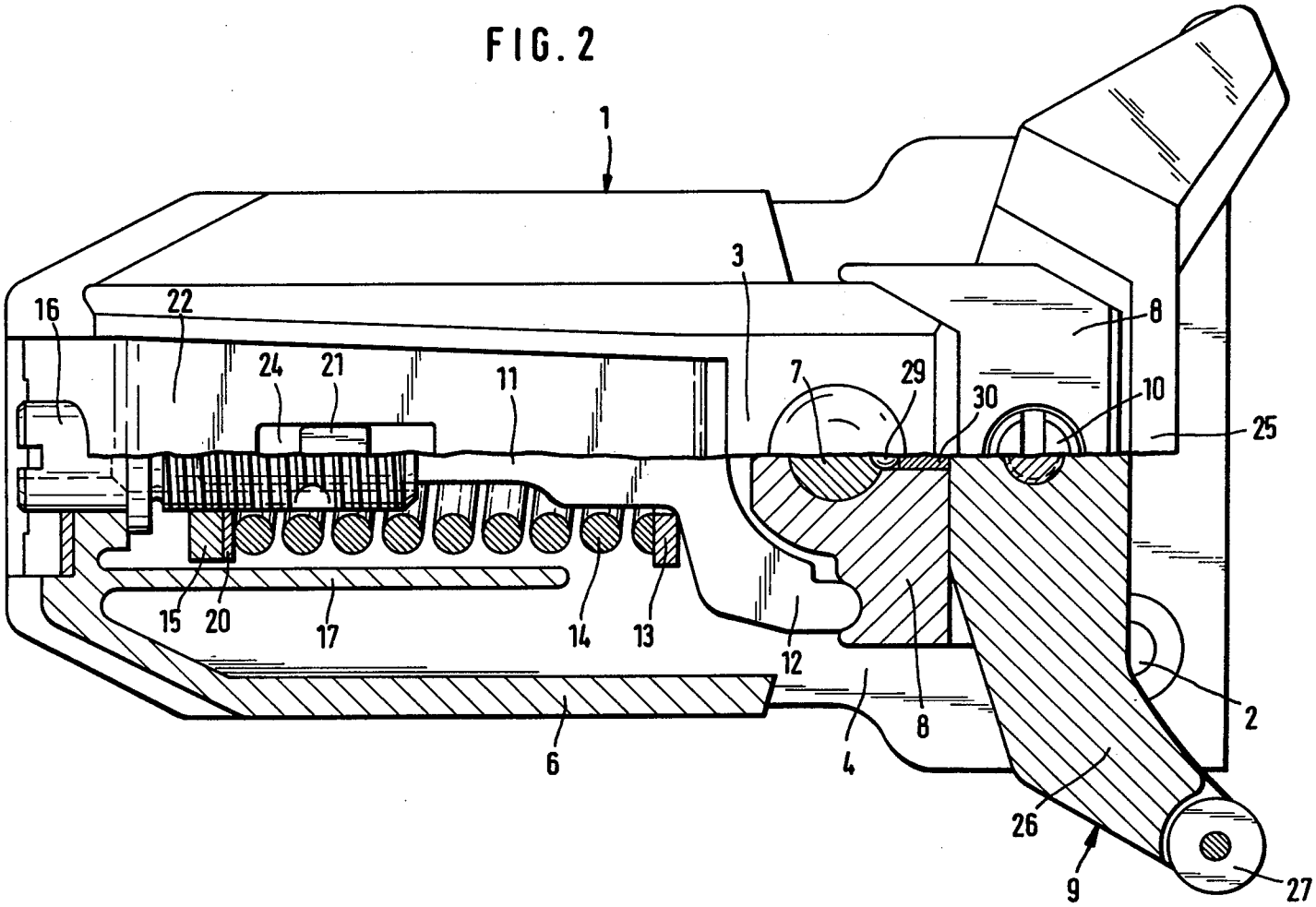
FIG. 2 The top half of FIG. 2 is a top view of a toe holder according to this invention, while the bottom half of FIG. 2 is sectional top view along the line II—II in FIG. 1.

FIG. 1 and FIG. 2 illustrate a preferred embodiment of a toe-holder according to this invention as having a housing 1, which may be mounted to a ski (not shown). Housing 1 is preferably mounted to the ski by means of screws; one screw hole 2 for such mounting is illustrated in FIG. 2. A ski boot is engageable at the rear of the toe holder, i.e. to the right in both FIG. 1 and FIG. 2.

Housing 1 has a base 4, a top wall 3, and side walls 5,6. Base 4 and top wall 3 extend beyond walls 5,6 towards the rear of the toe-holder. An axle 7 is fixably mounted between top wall 3 and base 4. A pivot member 8 is pivotally mounted on axle 7, while a sole engaging member 9 attached to pivot member 8 by means of a screw 10. Screw 10 is axially fixed with respect to pivot member 8 but is twistably mounted to allow for height adjustment of sole engaging member 9.

The sole engaging member might also comprise two independent arms, each arm screw mounted to the pivot member and height adjustable with respect to that member.

Sole engaging member 9 is provided for engaging the sole of a ski boot (not shown). Sole engaging member 9 comprises rollers 27 and a U-shaped member 25 having arms 26. One roller 27, with an axis substantially perpendicular to the top surface of the ski, is mounted on the end of each arm 26. Rollers 27 serve to reduce the friction when the ski boot is released from the ski.

A pressure applying member 11 and a spring 14 are provided for biasing pivot member 8 towards a skiing position, as illustrated in FIG. 1 and FIG. 2. Pressure applying member 11 has a forked end with prongs 12; one prong 12 positioned on each side of axle 7 and contacting pivot member 8.

Pressure member 11 is biased to the right as illustrated in FIG. 1 and FIG. 2 by spring 14. Spring 14 contacts on its right, as illustrated in the drawings, a plate 13 and, on its left, abuts a bow 20 adjacent a spring abutment piece 15. Abutment piece 15 is equipped with a system of screw threads for mounting it onto an adjustment screw 16 having mating screw threads. Adjustment screw 16, in turn, is mounted in an opening of a front wall 18 of housing 1. Screw 16 is retained in position by a flange 19, which flange is fixably mounted to housing 1. Ribs 17 extend from front wall 18 towards the rear of the toe holder. Abutment piece 15 is positioned between ribs 17 in such a manner that ribs 17 inhibit twisting movement of abutment piece 15.

Positioned between abutment piece 15 and spring 14 is bow 20, which is attached to an indicator 21. Indicator 21 is mounted in an opening 23 in top wall 3 and is retained in opening 23 by a retaining cover 22, which cover 22 also has an opening 24. Indicator 21 is slidable in the lengthwise direction of the toe holder.

Sole engaging member 9 engages the toe of a ski boot at the rear of the toe holder. Forces acting in the plane of the ski surface may cause twisting movement of the ski boot which results in pivoting of pivot member 8 about axle 7 towards a releasing position in which the ski boot is released from the ski. The magnitude of the force necessary to achieve pivoting of member 8 is controlled by spring 14 and pressure applying member 11, which bias member 8 towards its skiing position in which it holds the toe of a ski boot rigidly to the ski. Pivotal movement of member 8 about axle 7 urges one of the spurs 12 and, thus, pressure member 11, toward the front of the toe holder against the bias of spring 14. Under spring bias, the toe holder returns to its skiing position when the applied force ceases or when the ski boot is released from the ski.

Pivotal movement of pivot member 8 results not only in rotation of member 8 about axle 7, but also in upward movement of member 8 along the axis of axle 7. This is achieved by providing axle 7 with a generally semi-circular guide groove 28 located substantially centrally on axle 7. Groove 28 runs at an oblique angle upward about the circumference of axle 7 from a point on axle 7 closest to the rear of the toe holder and helically up axle 7 for about 90° around the axle. A bearing 29, mounted in an opening in pivot member 8, rides in groove 28. A retainer 30, also mounted in pivot member 8, urges bearing 29 into engagement with the surface defining groove 28. As pivot member 8 pivots about axle 7, bearing 29 is urged upward along the path provided by guide groove 28 resulting in upward vertical movement of pivot member 8 and sole engaging member 9. This accomodates the vertical component of applied forces and minimizes the frictional forces which might otherwise inhibit pivotal movement of pivot member 8 and release of the ski boot. With return of member 8 to its skiing position, bearing 29 urges member 8 to its original axial position on axle 7.

Release will occur even in the event of purely vertical forces. Retainer 30 is preferably an elastic material or comprises a spring loaded retaining member. When upwards forces are applied to the toe holder as in the case of a backward fall, bearing 29 is driven upwardly and therefore causes rotation of axle 7, to in turn rotate pivot member 8 and sole holder 9 to the releasing position.

Adjustment screw 16 may be used to adjust the releasing force of the toe holder. Twisting movement of screw 16 results in movement of abutment piece 15 along the shaft of screw 16, that is, along the longitudinal axis of the toe holder and the ski.. Ribs 17 inhibit pivotal movement of abutment piece 15 and limit it to longitudinal displacement. Movement of abutment piece 15 towards the rear of the toe holder results in compression of spring 14 and correspondingly greater stress on plate 13 and pressure applying member 11. In this case, greater force is required to overcome the retaining force of member 11 and achieve pivotal movement of member 8 about axle 7. Conversely, movement of abutment piece 15 towards the front of the toe holder decreases the force exerted by pressure applying member 11 on pivot member 8. This decreases the force required to achieve rotation of member 8 about axle 7 and obtain release of a ski boot from the ski. Indicator 21 moves simultaneously with abutment piece 15; thus, with proper calibration markings on cover 22, indicator 21 may be utilized to adjust the toe holder to various releasing forces.

A toe holder according to this invention retains the toe of the ski boot rigidly to the ski regardless of the release setting of the toe holder, thus minimizing the problem with "swimming" of the ski boot toe. Bearing 29, positioned in an opening in pivot member 8, is not vertically movable with respect to pivot member 8. Bearing 29 also engages guide groove 28 in axle 7 because guide groove 28 has a diameter substantially equivalent to the diameter of bearing 29. Thus, bearing 29 and, in turn, pivot member 8, are not vertically movable in the absence of pivotal movement of pivot member 8 about axle 7.

This invention has been described in detail with particular emphasis on its preferred embodiments, but it should be understood that there are variations and modifications within the scope and spirit of the invention.

What is claimed is:

1. A toe holder for safety ski bindings movable between a skiing and a releasing position for retaining the toe of a ski boot rigidly to a ski and releasing said ski boot from said ski on the application of forces dangerous to the skier, said toe holder comprising:

a housing fixedly mountable on a ski cylindrical axle means fixed in said housing and perpendicular to the top surface of a ski on which said toe holder is mounted;

sole holding means pivotally attached to said axle means for engaging the sole of a ski boot;

biasing means disposed within said housing and on one side of said axle for biasing said sole holding means towards a skiing position; and guide means associated with said sole holding means and said axle for urging said sole holding means vertically along said axle means as said sole holding means pivots about said axle means, said guide means comprises:

a guide groove in said axle means, said guide groove sloping helically upward about the circumference of said axle means from a point on the axle means closest to the rear of said toe holder;

a bearing mounted in said sole holding means on the opposite side of said axle from said biasing means and vertically fixed with respect to such holding means; and a retaining member mounted in said sole holding means, said retaining member urging said bearing into a position in which said bearing engages said guide groove; wherein said bearing urges said sole holding means away from the ski along the axis of said axle means as said sole holding means pivots about said axle means, and moves said toe holder from said skiing position to said releasing position in response to the vertical movement of said sole holding means.

2. A toe holder according to claim 1, wherein said sole holding means comprises a sole engaging member and pivot means; said pivot means pivotally mounted to said axle means and attached to said sole engaging member, for pivoting said sole engaging member about said axle means.

3. A toe holder according to claim 2, wherein said sole engaging member comprises a holding member with opposite arms, each arm having at least one roller on its end; each roller being mounted on an axis substantially perpendicular to the top surface of the ski; and wherein said toe holder further comprises screw means attaching said holding member to said pivot means for adjusting the height of said sole engaging member with respect to said pivot means.

4. A toe holder according to claim 1, wherein said biasing means comprises pressure applying means for contacting said sole holding means and spring means for biasing said pressure applying means against said sole holding means, urging said sole holding means towards said skiing position.

5. A toe holder according to claim 4, wherein adjustment means are provided for adjusting the tension on said spring means.

6. A toe holder according to claim 1, wherein said retaining member comprises a resilient member.

* * * * *